US010945087B2

(12) United States Patent
Yu et al.

(10) Patent No.: US 10,945,087 B2
(45) Date of Patent: Mar. 9, 2021

(54) AUDIO DEVICE ARRAYS IN CONVERTIBLE ELECTRONIC DEVICES

(71) Applicant: Lenovo (Singapore) Pte. Ltd., Singapore (SG)

(72) Inventors: Jonathan Jen-Wei Yu, Raleigh, NC (US); Aaron Michael Stewart, Raleigh, NC (US); Jeffrey E. Skinner, Raleigh, NC (US); Lincoln Penn Hancock, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/146,496

(22) Filed: May 4, 2016

(65) Prior Publication Data

US 2017/0325038 A1 Nov. 9, 2017

(51) Int. Cl.

*H04R 29/00* (2006.01)
*H04R 27/00* (2006.01)
*H04R 3/00* (2006.01)

(52) U.S. Cl.

CPC ..... *H04R 29/00* (2013.01); *H04R 3/00* (2013.01); *H04R 27/00* (2013.01); *H04R 29/001* (2013.01); *H04R 29/002* (2013.01); *H04R 29/004* (2013.01)

(58) Field of Classification Search

CPC ..... H04R 29/00; H04R 3/00; H04R 29/002; H04R 29/004; H04R 27/00; H04R 29/001
USPC ..... 381/58, 22, 23
See application file for complete search history.

(56) References Cited

U.S. PATENT DOCUMENTS 6,304,434 B1 * 10/2001 Markow ..... G06F 1/1616 312/223.1
8,243,961 B1 8/2012 Morrill
9,357,309 B2 * 5/2016 Meyer ..... G06F 3/165
2006/0161278 A1 * 7/2006 Maeda ..... H04M 1/0227 700/94
2010/0008523 A1 * 1/2010 Demuynck ..... H04M 1/0241 381/182
2012/0224299 A1 * 9/2012 Myers ..... H05K 5/0086 361/679.01
2013/0163794 A1 6/2013 Groves et al.
2014/0185852 A1 * 7/2014 Pereira ..... H04R 5/04 381/333
2014/0355781 A1 * 12/2014 Eckardt ..... H04R 1/1041 381/74

(Continued)

FOREIGN PATENT DOCUMENTS

CN 102662436 A 9/2012
CN 104516648 A 4/2015

(Continued)

*Primary Examiner* — Ammar T Hamid
(74) *Attorney, Agent, or Firm* — Ference & Associates LLC

(57) ABSTRACT

One embodiment provides an apparatus, including: a device housing; a sensor disposed within the device housing; a plurality of audio devices disposed within the device housing; a processor operatively coupled to the plurality of audio devices; and a memory storing instructions executable by the processor to: activate a first set of the plurality of audio devices; detect, using the sensor, a use mode; and change, using the processor, to a second active set of the plurality of audio devices based on the use mode. Other embodiments are described and claimed.

18 Claims, 5 Drawing Sheets

(56) References Cited

U.S. PATENT DOCUMENTS

| | | | | |
|---|---|---|---|---|
| 2015/0312691 | A1* | 10/2015 | Virolainen | H04R 29/005 381/58 |
| 2016/0162255 | A1* | 6/2016 | Nishimura | G06F 3/165 381/303 |
| 2016/0165350 | A1* | 6/2016 | Benattar | H04R 5/033 381/310 |
| 2016/0253145 | A1* | 9/2016 | Lee | G06F 3/04883 381/79 |

FOREIGN PATENT DOCUMENTS

| | | | |
|---|---|---|---|
| CN | 104571633 | A | 4/2015 |
| CN | 104866012 | A | 8/2015 |
| CN | 105159708 | A | 12/2015 |
| CN | 105353829 | A | 2/2016 |
| EP | 1473910 | A2 | 11/2004 |
| EP | 1742447 | A1 | 1/2007 |
| EP | 2605490 | A1 | 6/2013 |

* cited by examiner

AUDIO DEVICE ARRAYS IN CONVERTIBLE ELECTRONIC DEVICES

BACKGROUND

Electronic devices are offered in many different form factors such as laptop personal computers, tablets, smart phones, e-readers and the like. One such form factor is a convertible device, such as the LENOVO YOGA laptop personal computer, which typically includes two or more components that are hingedly attached such that they may be converted to multiple different physical orientations or configurations. For example, a convertible device may include a lower housing unit having a keyboard, touch pad, etc., which is hingedly attached to an upper housing or display unit that includes an LCD or other display device along with a touch screen. The two units of the convertible device may be joined together by a multi-axis hinge that allows the convertible device to be used as a traditional clamshell laptop, as a tablet device, in a tent mode, etc. In some form factors, devices or components are detachable. YOGA is a registered trademark of Lenovo (Beijing) Limited Corporation in the United States and other countries.

BRIEF SUMMARY

In summary, one aspect provides an apparatus, comprising: a device housing; a sensor disposed within the device housing; a plurality of audio devices disposed within the device housing; a processor operatively coupled to the plurality of audio devices; and a memory storing instructions executable by the processor to: activate a first set of the plurality of audio devices; detect, using the sensor, a use mode; and change, using the processor, to a second active set of the plurality of audio devices based on the use mode.

Another aspect provides a method, comprising: activating, using a processor of an electronic device, a first set of a plurality of audio devices; detecting, using a sensor of the electronic device, a device use mode; and changing, using the processor, to a second active set of the plurality of audio devices based on the device use mode.

A further aspect provides a program product, comprising: a program storage device comprising code, the code being executable by a processor and comprising: code that activates a first set of a plurality of audio devices of an electronic device; code that detects, using a sensor of the electronic device, a device use mode; and code that changes to a second active set of the plurality of audio devices based on the device use mode.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
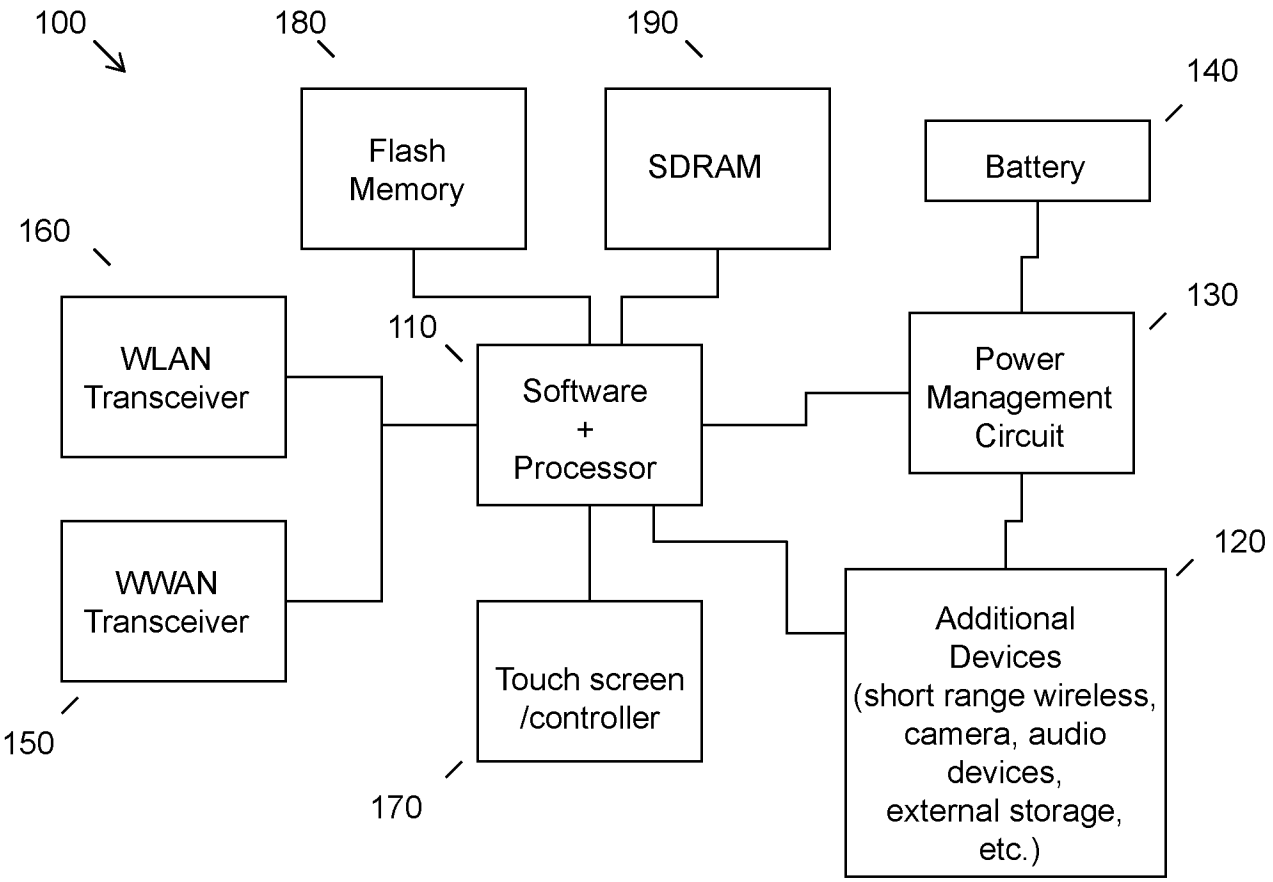
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Current audio solutions (audio input and/or output, I/O) for convertible devices do not optimize sound I/O for modes other than traditional clamshell. This forces the user to consume or produce audio content in clamshell mode or to use the device in other modes with sub-optimized audio output. Thus, with current convertible devices, the microphone and speakers are optimized for use in the traditional clamshell mode.

An embodiment therefore enhances the audio I/O (of the speakers and/or microphones) when in other modes or physical configurations, such as tent mode, closed-lid mode, and tablet mode. In an embodiment, audio devices (speakers and/or microphones) are embedded throughout the surface (s) of the convertible device and may even be incorporated into the hinge of the convertible device. The convertible device is thus able to output sound that is best suited for the current mode of the convertible device as well as the context that the user(s) are in when interacting with the convertible device.

As will be readily apparent from this description, various embodiments may be applied to convertible device or to non-convertible (i.e., traditional) device form factors, e.g., tablets, bar-type phones or flip phones, smart phones generally, clamshell style laptops, e-readers, etc. Such non-convertible or traditional device form factors will benefit from several of the embodiments; however, a convertible device is used throughout as an illustrative and non-limiting example.

By distributing the speakers and microphone throughout the device (e.g., on the "A," "C," and "D" covers and in hinge), as well as micro-perforating the device surfaces, sound can be received or projected to best represent the quality and spatial profile originally intended by the content creator or the user, no matter what physical configuration, use mode or use context the device is in. By leveraging gyroscopic, hinge, user presence data (collected for example via sensors (and associated sub-systems) for facial recognition or eye tracking, GPS, WIFI or other wireless network awareness, etc.), the device can alter the mix of the sound to best suit the physical configuration, position, orientation and/or mode the device is in. This includes in some examples taking into account the position of the user(s) relative to the device, whether directly detected or inferred.

By way of non-limiting example, when in a tent mode, the A and D covers of the device, along with the hinge, include embedded speakers that can automatically reconfigure the sound mix (in terms of speaker devices utilized to produce sound) to take advantage of the spatial chamber created when the device is placed on a table or flat surface (i.e., in tent mode on a flat surface). The acoustic profile of the "sound chamber" created from the device in tent mode can be used to optimize the sound mix.

Another non-limiting example includes, when in a closed-lid mode (a traditional laptop clamshell closed) or in a tablet mode (where the device's touch screen or main display is rotated outward), the device's microphone array, speakers, and sensors can enable new use cases in terms of audio I/O management. For example, when in a closed-lid mode, the device's microphone arrays may detect the direction of a user speaking commands to it. Using this spatial information relative to the device, an embodiment automatically direct audio output from the embedded speakers in the direction of the user. Further, an embodiment may activate microphones determined to be proximate to the user's position for receiving higher quality audio input.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are included, e.g., audio devices. System 100 often includes a touch screen 170 for data input and display/rendering. System 100 also typically includes various memory devices, for example flash memory 180 and SDRAM 190.

Figure 2:
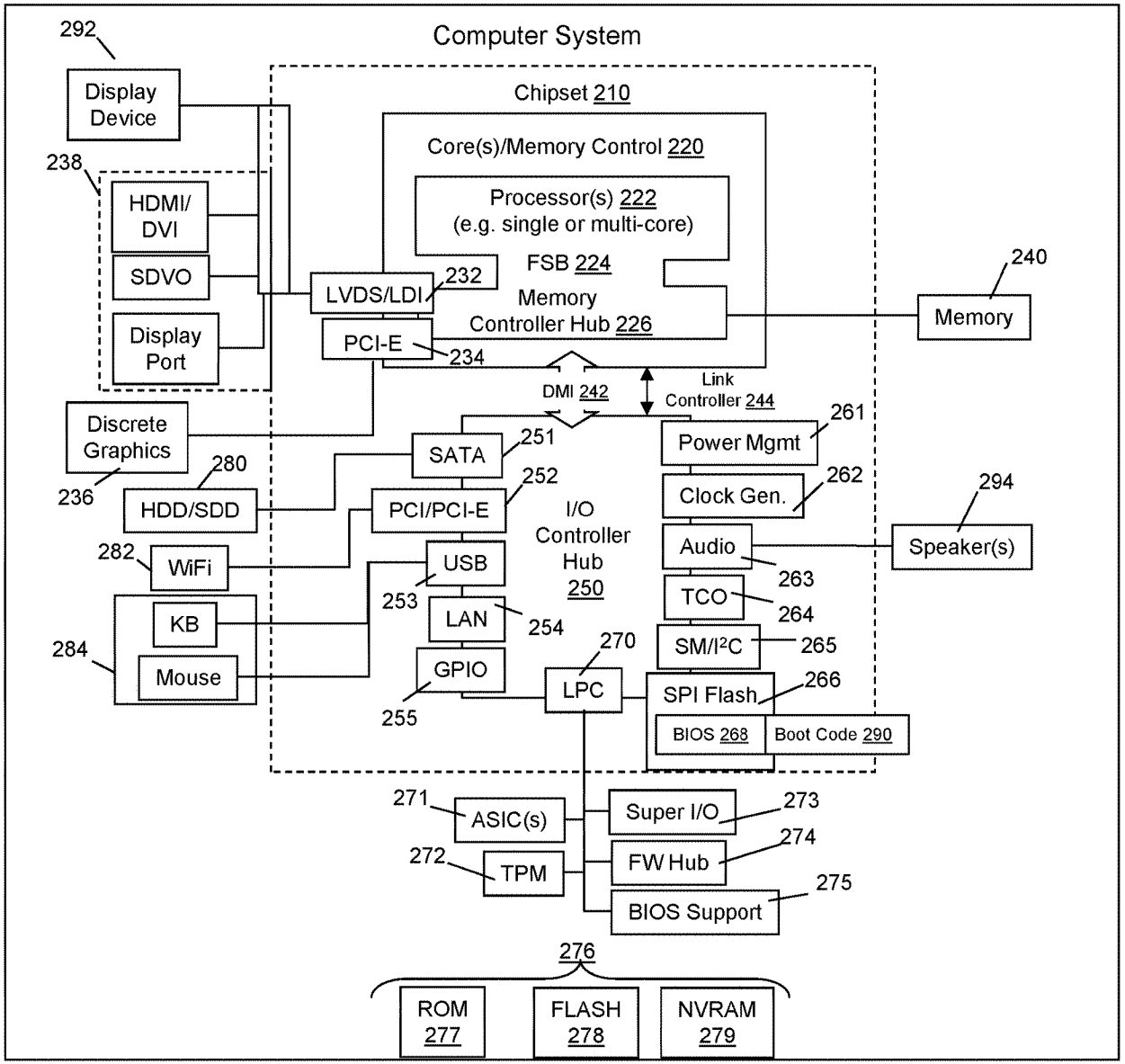
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2. THINKPAD is a registered trademark of Lenovo PC International Limited Liability Company in the United States and other countries.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings PLC in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAIVI 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in convertible devices as well as other electronic devices. For example, the circuitry outlined in FIG. 1 may be used in a tablet type computing device, a smart phone, an e-reader, and the like; or, the circuitry outlined in FIG. 1 may be incorporated (in whole or in part) into the upper or display unit of a convertible device. Likewise, the circuitry outlined in FIG. 2 may be used in a laptop personal computer device and the like; or, the circuitry outlined in FIG. 2 may be incorporated (in whole or in part) into a convertible device, e.g., forming a lower or main unit of a convertible device.

Referring to FIG. 3(A-B), in the non-limiting example of a convertible device 300A, 300B having a lower or main housing, including a keyboard 301A, touch pad 302A, etc., and having an upper or display housing, including a touch screen or other display screen, the convertible device according to an embodiment incorporates a plurality of audio devices in one or both of the upper housing and the lower housing.

In an embodiment, the upper and lower housing surfaces are micro-perforated surfaces that provide for inlet and/or outlet for sound. For example, if the audio devices include a speaker or speakers, the micro-perforated surface material permits sound production from any part of the device surface selected for activation, e.g., based on device use mode. Likewise, if the audio devices include a microphone or microphones, the micro-perforated surface material permits sound pickup from any part of the device surface selected for activation.

An embodiment includes audio devices in a plurality of locations, e.g., disposed beneath micro-perforated surfaces of the upper and lower housings, the hinge (if any), and bezel areas. This permits the device 300A, 300B to produce sound and/or pick up sound in a plurality of directions, e.g., as adapted to intelligently account for device use mode or configuration.

Figure 3B:
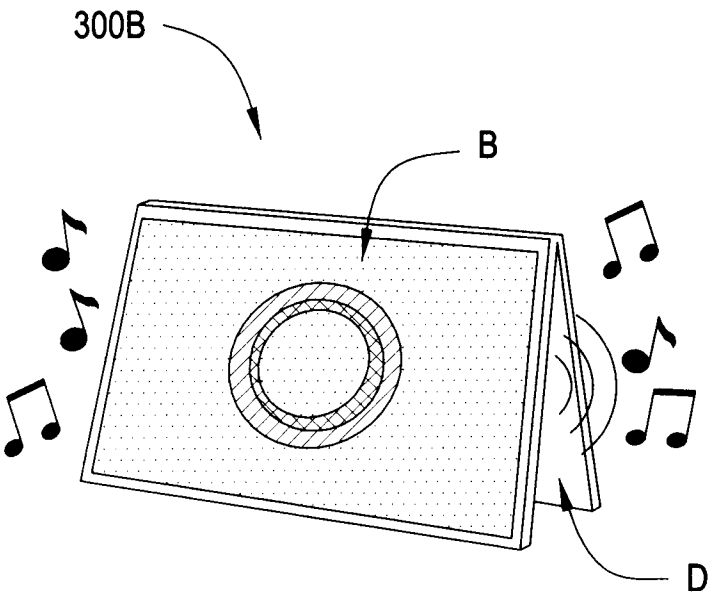
FIG. 3(A-B) illustrates an example convertible device in different use modes.
Figure 3A:
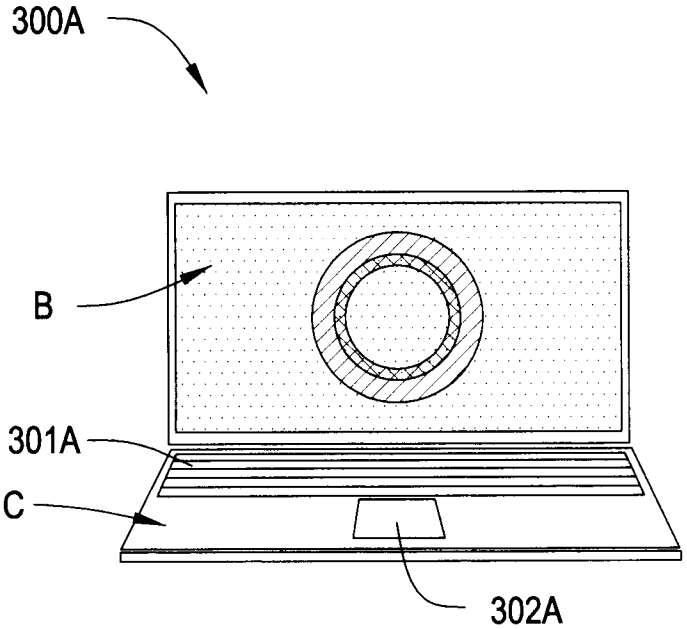

As illustrated in FIG. 3A, the device 300A is in a traditional clamshell mode in which the B and C sides are facing the user (not pictured in FIG. 3(A-B)). In the use mode illustrated in FIG. 3A, one or more audio devices (e.g., speakers, microphones), may be selectively activated to match the clamshell use mode. As such, audio devices disposed in the upper housing on the B side of the device may be activated, whereas those on the A side of the upper housing may not be activated, as this A side typically faces away from the user in the clamshell mode.

An embodiment may detect the clamshell mode (or other use modes, as described further herein) using one or more sensors. For example, the main or lower housing of the device 300A may include an orientation sensor or 9-axis sensor package that indicates that the device has been placed in a level position, e.g., on a table top, and is not undergoing movement. Similarly, another sensor or sensors, such as a sensor disposed in the device hinge or hinges, as well as other locations, may indicate that the lid has been opened. Further, other sensors may be utilized, alone or in some combination, as further described herein with the non-limiting examples illustrated in FIG. 4(A-B).

In the mode or configuration shown in FIG. 3A, the device 300A is determined to be in a lid open clamshell mode. As such, an embodiment will intelligently activate audio devices to more suitably match this mode of use. For example, audio devices such as speakers on the B and C sides of the device may be activated, whereas other audio devices may be deactivated or switched off, e.g., those disposed in the A and D sides.

Turning to FIG. 3B, therein the device 300B is illustrated in a tent mode, where the B side of the device 300B has been rotated away from the C side (not shown in FIG. 3B) past 180 degrees. This permits the user to place the device 300B on a table top or like surface. As such, the D side of the device 300B (the bottom or underside face of the device) is proximate to the A side (the top of the device or lid cover, not indicated in FIG. 3B, but indicated in FIG. 4A).

If one or more sensors detect that the device 300B has been placed in tent mode, an embodiment may switch or change which audio devices are active, e.g. which speakers will be used for producing sound. As illustrated, in tent mode the device 300B may activate speakers on the D side and A side of the device 300B such that a sound chamber is produced for audio output.

This leads to a richer audio output, particularly if the audio devices activated are selected based on the use mode plus the type of audio being produced or received. For example, an embodiment may detect that a certain audio type is being produced (e.g., an audio file of a particular music or music type, audio containing dialogue in connection with a video file, audio provided by a particular application type, audio produced in a certain geographic location, etc.) and may detect a certain device use mode, e.g., tent mode as illustrated in FIG. 3B. On the basis of these inputs, an embodiment intelligently matches which audio devices (in this example case, speakers) to activate given these data inputs to achieve the most appropriate sound production for the use case.

Other data may be used in connection with device use mode data as well. As illustrated by way of example in FIG. 4A, an embodiment may utilize data from a sensor such as a camera that a user is in a particular orientation or position with respect to the device 400A. This data input, along with a detection of the device's physical configuration, here a closed lid—clamshell mode, may be used to select particular audio devices for receiving and/or producing audio input for this use mode.

Figure 4A:
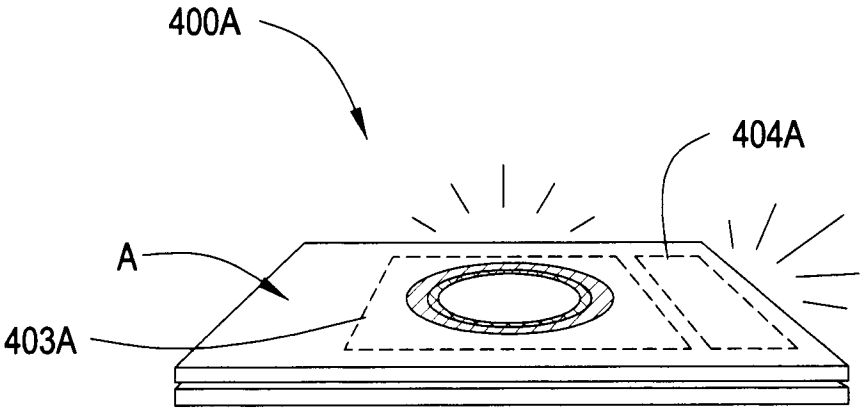
FIG. 4(A-B) illustrates an example convertible device in further different use modes.

In the example shown in FIG. 4A, an embodiment may selectively activate speakers disposed under a micro-perforated surface in the lid or A side in a particular area 403A to produce audio output, e.g., audible dialogue from a virtual assistant that responds to user-issued audible input. The user-issued audible input may be received by activated microphones disposed in the lid on the A side in another area 404A, e.g., based on an image detection and/or directional audio detection of the user being in a particular orientation or position with respect to the device.

Figure 4B:
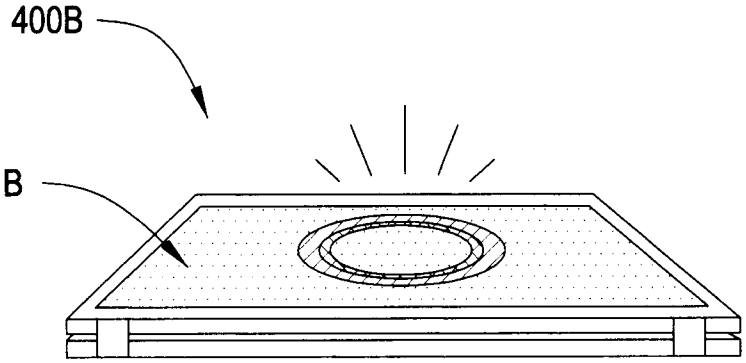

As shown in the example of FIG. 4B, the device 400B may activate other audio devices if a tablet mode is detected, i.e., a use mode in which the upper housing or lid has been closed by the user with the display screen or B side facing upwards. In such a case, an embodiment may activate audio devices, e.g., speakers, in the B side of the device, either speakers underlying a micro-perforated display screen, speakers placed within the bezel (which may or may not be disposed beneath a micro-perforated bezel material), or a combination of the foregoing. This permits sound production to be transmitted from a side or surface of the device, herein the B side, such that it produces the highest quality audio possible.

Figure 5:
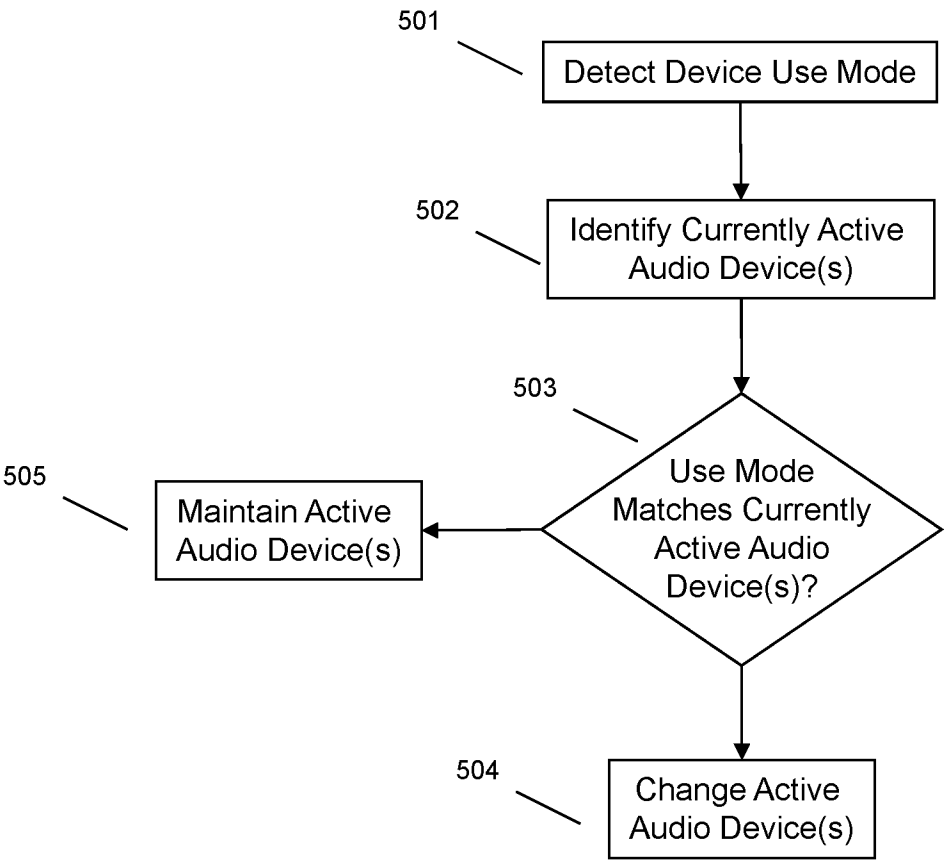
FIG. 5 illustrates an example of changing active audio device arrays used in a convertible electronic device based on the use mode detected.

FIG. 5 outlines a method of using audio device arrays based on the device use mode detected. As illustrated, at 501 an embodiment detects the device use mode, e.g., based on one or a combination of sensor inputs (e.g., orientation sensors, cameras, microphones, contact sensors (e.g., capacitive or resistive sensors), network detection sensors, etc.). The detection of the device use mode may also take into account the use context of the device to produce (e.g., play, output) or receive (e.g., pick up) a particular audio or audio type in addition to taking into account the device's physical configuration. For example, the use mode of tent mode or tablet mode may be modified or adjusted based on a type of audio being produced, received, or both. In an embodiment, this detection may comprise detecting which application(s) are actively participating in audio pick up or production, such as detecting an activated virtual assistant application, an activated media player, etc. As described herein, the type of audio to be produced or received, or both, may influence which audio devices are activated, in combination with the detection of the device's physical configuration, orientation, positioning with respect to the user, geographic location, network connection status, etc.

Have a device use mode identified at 501, an embodiment may identify currently active audio devices, if any, at 502. For example, an embodiment may identify that a default speaker or microphone is set as active for audio production and pickup, respectively, e.g., based on a last detected mode (for example, clamshell mode).

If the current use mode does not match the currently active audio devices, as determined at 503, an embodiment may change the active audio devices to better suit the current use mode, as illustrated at 504. By way of example, if the audio devices identified at 502 are best suited for clamshell use mode, but the device is currently physically configured in a tent mode, as detected at 501, an embodiment may change the audio devices to be utilized to another, second set, as illustrated at 504. The second set of activated devices may contain some or all of the first set of audio devices. On the other hand, if the currently active audio devices are acceptable for the detected use mode, the currently active audio devices may be maintained.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. An apparatus, comprising:

a device housing comprising an upper housing and a lower housing, the upper housing and the lower housing operatively connected by at least one hinge, wherein the at least one hinge allows rotation of the upper housing in a plane other than parallel to the plane of the lower housing, wherein the device housing comprises at least one micro-perforated surface, wherein the at least one micro-perforated surface provides an inlet and an outlet for sound;

a sensor disposed within the device housing;

a plurality of audio devices disposed within the device housing, at least one of the audio device being located beneath the at least one micro-perforated surface, wherein at least one set of the plurality of audio devices is disposed on a display side of the upper housing and wherein at least another set of the plurality of audio devices is disposed on a side substantially opposite the display side of the upper housing;

a processor operatively coupled to the plurality of audio devices; and a memory storing instructions executable by the processor to:

detect, using the sensor, a use mode of the apparatus, wherein the use mode is based upon an orientation of the display side of the upper housing with respect to the lower housing orientation, based upon user presence data, collected from at least one sensor, identifying a position of a user with respect to the device, and based upon an audio type being produced during the use mode; and activate a set of the plurality of audio devices based on the use mode to achieve a desired sound production based upon the use mode, wherein to activate comprises leaving another set of the plurality of audio devices deactivated.

2. The apparatus of claim 1, wherein the device sensor comprises a device orientation sensor.

3. The apparatus of claim 1, wherein the device sensor comprises a contact sensor.

4. The apparatus of claim 1, wherein the device sensor comprises a camera.

5. The apparatus of claim 1, wherein the device sensor comprises a microphone.

6. The apparatus of claim 1, wherein the at least one surface comprises a plurality of surfaces.

7. The apparatus of claim 1, wherein at least one of the plurality of audio devices is a speaker.

8. The apparatus of claim 7, wherein the plurality of audio devices comprises a speaker array.

9. The apparatus of claim 1, wherein at least one of the plurality of audio devices is a microphone.

10. A method, comprising:

detecting, using a sensor of an electronic device comprising an upper housing and a lower housing, the upper housing and the lower housing operatively connected by at least one hinge allowing rotation of the upper housing in a plane other than parallel to the plane of the lower housing, wherein at least one of the upper housing and the lower housing comprises at least one micro-perforated surface, wherein the at least one micro-perforated surface provides an inlet and an outlet for sound, a device use mode, wherein the device use mode is based upon an orientation of a display side of the upper housing with respect to the lower housing orientation, based upon user presence data, collected from at least one sensor, identifying a position of a user with respect to the device, and based upon an audio type being produced during the use mode;

the electronic device comprising a plurality of audio devices disposed within the device housing, at least one of the audio device being located beneath the at least one micro-perforated surface, wherein at least one set of the plurality of audio devices is disposed on the display side of the upper housing and wherein at least another set of the plurality of audio devices is disposed on a side substantially opposite the display side of the upper housing; and activating a set of the plurality of audio devices based on the device use mode to achieve a desired sound production based upon the use mode, wherein to activate comprises leaving another set of the plurality of audio devices deactivated.

11. The method of claim 10, wherein the detecting comprises detecting a device orientation.

12. The method of claim 10, wherein the detecting comprises detecting physical contact between the electronic device and another object.

13. The method of claim 10, wherein the detecting comprises user presence via optical imaging.

14. The method of claim 10, wherein the detecting comprises detecting directional audio using one or more microphones.

15. The method of claim 10, wherein at least one of the plurality of audio devices produces audible output.

16. The method of claim 15, wherein the plurality of audio devices comprises a speaker array.

17. The method of claim 10, wherein at least one of the plurality of audio devices captures directional audio data.

18. A program product, comprising:

a program storage device comprising code, the code being executable by a processor and comprising:

code that detects, using a sensor of an electronic device comprising an upper housing and a lower housing, the upper housing and the lower housing operatively connected by at least one hinge allowing rotation of the upper housing in a plane other than parallel to the plane of the lower housing, wherein at least one of the upper housing and the lower housing comprises at least one micro-perforated surface, wherein the at least one micro-perforated surface provides an inlet and an outlet for sound, a device use mode, wherein the device use mode is based upon an orientation of a display side of the upper housing with respect to the lower housing orientation, based upon user presence data, collected from at least one sensor, identifying a position of a user with respect to the device, and based upon an audio type being produced during the use mode;

code that detects the electronic device comprising a plurality of audio devices disposed within the device housing, at least one of the audio device being located beneath the at least one micro-perforated surface, wherein at least one set of the plurality of audio devices is disposed on the display side of the upper housing and wherein at least another set of the plurality of audio devices is disposed on a side substantially opposite the display side of the upper housing; and code that activates a set of the plurality of audio devices based on the device use mode to achieve a desired sound production based upon the use mode, wherein the code that activates comprises code that leaves another set of the plurality of audio devices deactivated.

* * * * *